US011557213B1

(12) United States Patent
Curlander

(10) Patent No.: US 11,557,213 B1
(45) Date of Patent: Jan. 17, 2023

(54) AIR-TRAFFIC SYSTEM

(71) Applicant: Amazon Technologies, Inc., Seattle, WA (US)

(72) Inventor: James C. Curlander, Bellevue, WA (US)

(73) Assignee: Amazon Technologies, Inc., Seattle, WA (US)

( * ) Notice: Subject to any disclaimer, the term of this patent is extended or adjusted under 35 U.S.C. 154(b) by 347 days.

(21) Appl. No.: 16/834,722

(22) Filed: Mar. 30, 2020

(51) Int. Cl.
*G08G 5/00* (2006.01)
*H04R 3/00* (2006.01)

(52) U.S. Cl.
CPC ..... *G08G 5/0082* (2013.01); *G08G 5/0013* (2013.01); *G08G 5/0039* (2013.01); *G08G 5/0043* (2013.01); *H04R 3/005* (2013.01)

(58) Field of Classification Search
CPC .. G08G 5/0082; G08G 5/0013; G08G 5/0039; G08G 5/0043; H04R 3/005
See application file for complete search history.

(56) References Cited

U.S. PATENT DOCUMENTS 11,073,362 B1 * 7/2021 Barnawi ..... B64C 39/024
2017/0219686 A1 * 8/2017 Xie ..... G01S 11/14
2019/0228667 A1 * 7/2019 Matsumoto ..... G08G 5/0026
2019/0355263 A1 * 11/2019 Priest ..... G08G 5/0013
2020/0322041 A1 * 10/2020 Chao ..... H04L 9/3239
2021/0233554 A1 * 7/2021 Buddhadev ..... G10L 25/30

OTHER PUBLICATIONS

A. Sedunov, D. Haddad, H. Salloum, A. Sutin, N. Sedunovand A. Yakubovskiy, "Stevens Drone Detection Acoustic System and Experiments in Acoustics UAV Tracking," 2019 IEEE International Symposium on Technologies for Homeland Security (HST), 2019 , pp. 1-7) (Year: 2019).*

* cited by examiner

*Primary Examiner* — Shon G Foley
(74) *Attorney, Agent, or Firm* — Athorus, PLLC

(57) ABSTRACT

Described are systems and methods that utilize nodes distributed at different geographic locations to detect and track the approximate position, trajectory, and/or predicted path of aerial vehicles operating below a defined altitude (e.g., 500 feet). As nodes detect an aerial vehicle, the node determines a bearing toward the aerial vehicle and provides the bearing to an air-traffic system. The air-traffic system processes bearings received from each node and determines one or more of an approximate position, trajectory, and/or predicted path of the detected aerial vehicle. The approximate position, trajectory, and/or predicted path may be provided to one or more subscribing clients and/or used to alter paths of one or more aerial vehicles.

19 Claims, 12 Drawing Sheets

AIR-TRAFFIC SYSTEM

BACKGROUND

Many aerial vehicles, such as unmanned aerial vehicles, helicopters, Cessna airplanes, etc., operating at lower altitudes (e.g., below 500 feet) do not transmit any identifying information that can be used to determine the position, trajectory, and/or path of the vehicle, referred to herein as non-reporting aerial vehicles. For controlled airspaces, such as airports, aerial vehicles entering the space are tracked using radar. However, there currently exists no solution to track or locate non-reporting aerial vehicles outside of a controlled airspace.

BRIEF DESCRIPTION OF DRAWINGS

The detailed description is described with reference to the accompanying figures.

DETAILED DESCRIPTION

Described are systems and methods that utilize nodes distributed at different geographic locations to detect and track the approximate position, trajectory, and/or predicted path of aerial vehicles operating below a defined altitude (e.g., 500 feet). Each node may use inexpensive means such as cameras, short range radar, microphone arrays, etc., to detect and track an aerial vehicle that is within range of the node. When a node of the system detects an aerial vehicle, the node generates node data that includes, among other information, a bearing (azimuth and elevation) of the detected aerial vehicle with respect to the geographic location of the node. The node data is then provided by the node to an air-traffic system executing on one or more remote computing resources.

The air-traffic system, as discussed further below, processes node data received from each of a plurality of nodes of the system and utilizes that node data to determine the approximate position of each aerial vehicle detected by nodes of the system. As node data is received over a period of time, those approximate positions may be used to determine a trajectory of each aerial vehicle and/or to predict a path of the aerial vehicle.

The air-traffic system may aggregate the received and processed node data and provide some or all of the data to other systems, aerial vehicles, etc., referred to herein generally as subscribing clients. For example, a subscribing client may identify one or more nodes of the system for which it desires to receive data and the air-traffic system may process node data received from those nodes and provide air-traffic related information to the subscribing client. In other examples, the air-traffic system may operate as an air-traffic control system for some or all aerial vehicles, determine the approximate position and/or trajectory of each aerial vehicle and, as needed, compute and provide to one or more aerial vehicles within the area alternative paths to be navigated by those aerial vehicle so the aerial vehicles operate safely.

Figure 1A:
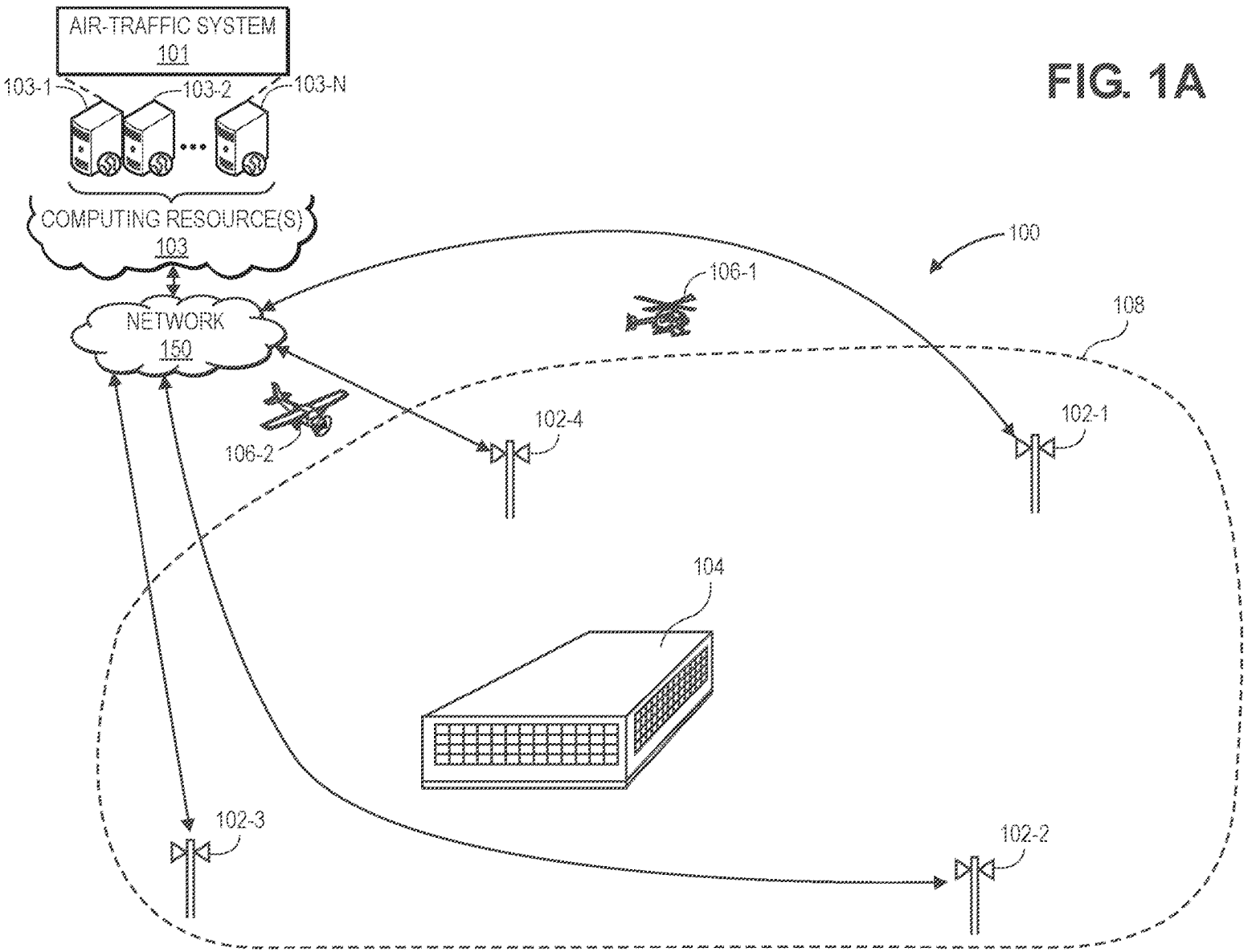
FIGS. 1A, 1B, and 1C illustrate an example system that may be used to determine and track aerial vehicles around the materials handling facility, in accordance with described implementations.
Figure 1B:
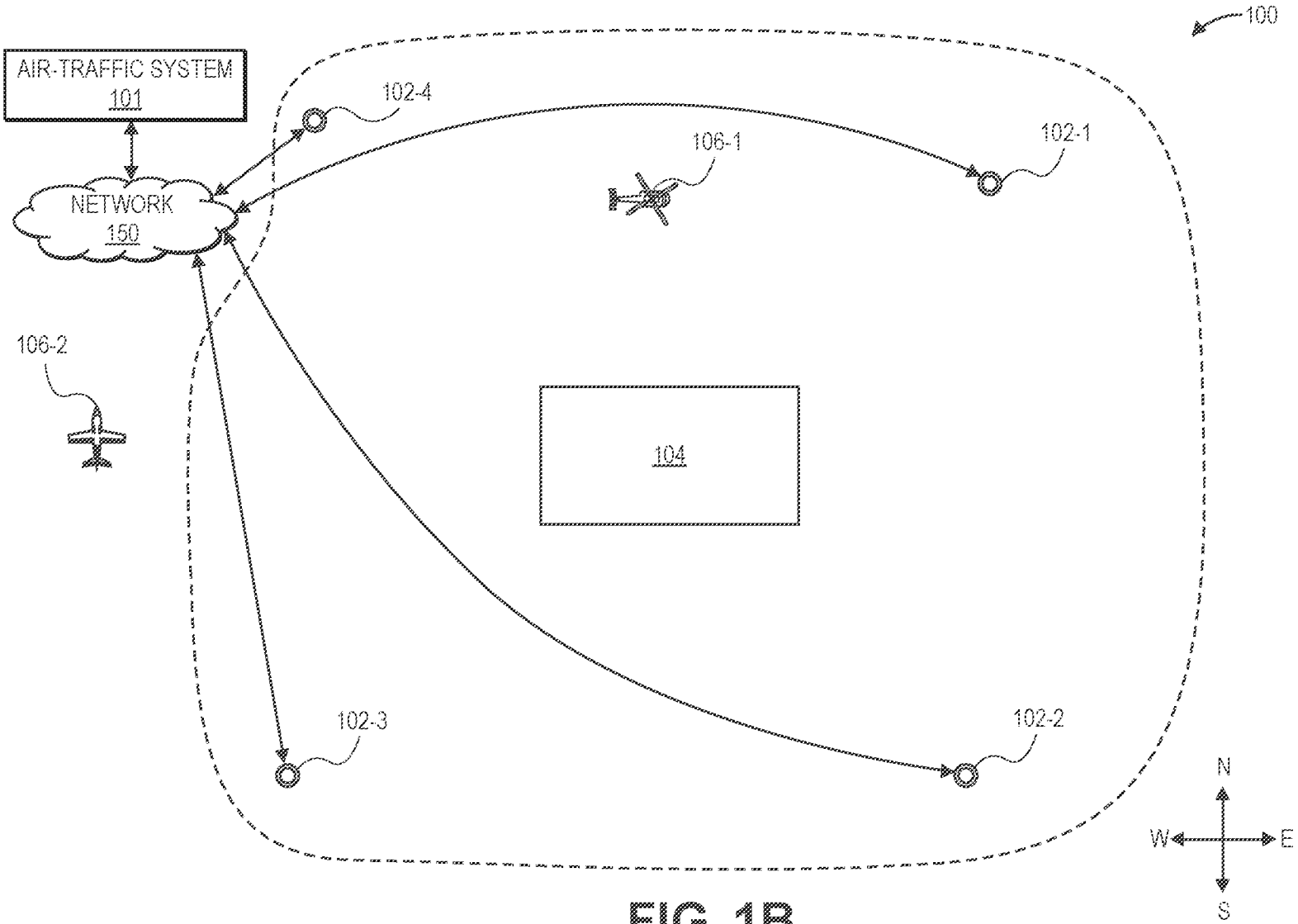
Figure 1C:
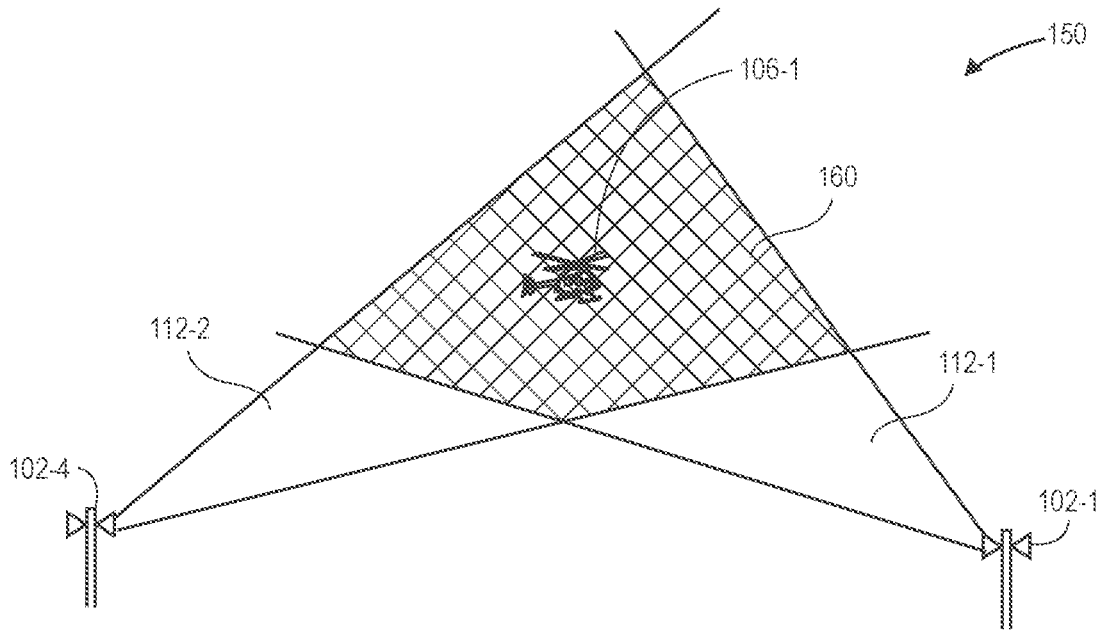

FIGS. 1A, 1B, and 1C illustrate an example system 100 around a materials handling facility that may be used to determine and track aerial vehicles around the materials handling facility, in accordance with described implementations.

As discussed in further detail below, the system includes two or more nodes, such as nodes 102-1, 102-2, 102-3, 102-4 distributed at different geographic locations about an area 108 and an air-traffic system 101 executing on one or more computing resources 103-1, 103-2, through 103-N that communicate with the nodes via a network 150, such as the Internet. In the example illustrated in FIGS. 1A and 1B, the area 108 is an area around a materials handling facility 104.

A materials handling facility, as used herein may be any type of building or location that stores or maintains items that are to be shipped or transported to and/or from the material handling facility. Transport may be performed by ground vehicle, aerial vehicle, water vehicle, etc. In some implementations, some or all transport of items to and/or from the materials handling facility may be performed using unmanned aerial vehicles ("UAV").

In operation, each node 102 may use inexpensive hardware, such as cameras, short range radar, etc., to detect aerial vehicles operating within the area and provide node data indicating a bearing of the detected aerial vehicle, such as aerial vehicles 106-1, 106-2 to the air-traffic system 101. For example, some or all of the nodes 102 may use a microphone array to detect sounds within the environment, determine a bearing (azimuth and elevation) corresponding to a source of the sound, and classify those sounds as aerial vehicle or not aerial vehicle. If the sounds are determined to be generated by an aerial vehicle, node data that includes the bearing of the aerial vehicle may be provided to the air-traffic system. For example, a node that includes an acoustic array of microphones may be tuned to detect sounds generated by small aerial vehicles (e.g., UAVs, propeller planes, helicopters, Cessna, etc.) that typically operate at altitudes below 500 feet. For example, motors of small aerial vehicles generally produce sounds in the range of 60-200 Hertz ("Hz"). As a node detects sounds in this range, the time difference of arrival of the sounds to different microphones of the microphone array may be used to determine a bearing for a source of the sound with respect to the node 102.

If the node 102 classifies the sound as generated by an aerial vehicle, the node generates and provides node data that may include one or more of a timestamp corresponding to the sound, a bearing (azimuth and elevation) for the sound, an identifier assigned to the sound by the node, the detected and recorded sound, a bearing of the aerial vehicle, a speed of the aerial vehicle, a type of the aerial vehicle (determined from the detected sound), etc. The node data is then sent, via a network 150, from the node 102 to the air-traffic system 101.

As another example, the node may include sensors in the form of one or more cameras, such as a Red, Green, Blue (RGB) camera, that generates image data for a field of view of the camera. The image data may be processed using one or more image processing algorithms, such as an object detection algorithm, edge detection algorithm, etc., to determine if an object is represented in the image data and, if so, whether the object is an aerial vehicle. If the image data is determined to include a representation of an aerial vehicle, node data that includes the bearing of the aerial vehicle may be provided to the air-traffic system. For example, a node that includes a camera may include algorithms, such as a trained machine learning algorithm, that may process image data to determine if the object represented in the image data corresponds to a small aerial vehicle (e.g., UAVs, propeller planes, helicopters, Cessna, etc.) that typically operates at altitudes below 500 feet, based on the size and/or shape of the object represented in the image data. As a node detects objects having a size and/or shape that corresponds to an aerial vehicle, the image may be further processed to determine the bearing of the aerial vehicle based on the pixel position of the object in the image data, the location of the camera at the node and the field of view of the camera.

If the node 102 classifies the object represented in the image data as representative of an aerial vehicle, the node generates and provides node data that may include one or more of a timestamp corresponding to the object, a bearing (azimuth and elevation) for the object, an identifier assigned to the object by the node, the image data that includes the representation of the object, a bearing of the aerial vehicle, a speed of the aerial vehicle, a type of the aerial vehicle (determined from the size and/or shape of the object), etc. The node data is then sent, via a network 150, from the node 102 to the air-traffic system 101.

Referring to FIG. 1B, which is a top down view of the system configuration 100, each of the nodes 102-1, 102-2, 102-3, 102-4 positioned at different geographic locations within the area 108 around the materials handling facility 104 may detect the sounds of aerial vehicles 106-1 and/or 106-2 as they pass around or through the area 108. For example, the first node 102-1 may detect sound generated by the first aerial vehicle 106-1, determine that the sound corresponds to an aerial vehicle and determine a first bearing toward a source of the detected sound/first aerial vehicle 106-1. However, the second aerial vehicle 106-2 may be beyond the range of the first node 102-1 and therefore may not be detected by the first node. The second node 102-2 may detect sound generated by the first aerial vehicle 106-1, determine that the sound corresponds to an aerial vehicle and determine a second bearing toward a source of the detected sound/first aerial vehicle 106-1. However, like the first node, the second aerial vehicle 106-2 may be beyond the range of the second node and therefore not detected by the first node. The third node 102-3 may detect sound generated by the second aerial vehicle 106-2, determine that the sound corresponds to an aerial vehicle and determine a third bearing toward a source of the detected sound/second aerial vehicle 106-2. However, in this example, the first aerial vehicle 106-1 may be beyond the range of the third node and therefore not detected by the third node. Finally, the fourth node 102-4 may detect sounds generated by the first aerial vehicle 106-1 and the second aerial vehicle 106-2, as they are both within range of the fourth node. The fourth node, may determine that both of the received sounds generated by the two aerial vehicles 106-1, 106-2 are aerial vehicles, determine a fourth bearing toward a source of the sound of the second aerial vehicle 106-2 and a fifth bearing toward a source of the sound of the first aerial vehicle 106-1.

As each node 102 detects sounds, determines the sounds are from aerial vehicles, and computes bearings for the sounds, node data that includes a timestamp, node identifier, and determined bearing(s) for each detected aerial vehicle are generated and sent through a network 150 from each node 102 to the air-traffic system 101. As will be appreciated, the node data may be sent via any combination of wired and/or wireless (e.g., Bluetooth, Wi-Fi, cellular, satellite, etc.) transmissions and through one or more networks, such as local area networks, wide area networks, the Internet, etc.

In another implementation, each of the nodes 102-1, 102-2, 102-3, 102-4 positioned at different geographic locations within the area 108 around the materials handling facility 104 may utilize cameras to generate image data that is used to visually detect aerial vehicles 106-1 and/or 106-2 as they pass around or through the area 108. For example, the first node 102-1 may generate first image data that includes first pixel data representative of the first aerial vehicle 106-1, determine that the shape of the object represented by the first pixel data corresponds to an aerial vehicle and determine a first bearing toward that object based on the pixels and the field of view of the camera. However, the second aerial vehicle 106-2 may be beyond the range of the first node 102-1 and therefore may not be detected by the first node. The second node 102-2 may generate second image data that includes second pixel data representative of the first aerial vehicle 106-1, determine that the shape of the object represented by the second pixel data corresponds to an aerial vehicle and determine a second bearing toward that object based on the pixels and the field of view of the camera. However, like the first node, the second aerial vehicle 106-2 may be beyond the range of the second node and therefore not detected by the first node. The third node 102-3 may generate third image data that includes third pixel data representative of the second aerial vehicle 106-2, determine that the shape of the object represented by the third pixel data corresponds to an aerial vehicle and determine a third bearing toward that object based on the pixels and the field of view of the camera. However, in this example, the first aerial vehicle 106-1 may be beyond the range of the third node and therefore not detected by the third node. Finally, the fourth node 102-4 may generate fourth image data that includes fourth pixel data representative of the first aerial vehicle 106-1 and fifth pixel data representative of the second aerial vehicle 106-2, as they are both within range of the fourth node and within the field of view of the camera of the fourth node. The fourth node may determine that the shape and/or size of the objects represented by both the fourth pixel data and the fifth pixel data correspond to aerial vehicles, determine a fourth bearing toward the object represented by the fourth pixel data and determine a fifth bearing toward the object represented by the fifth pixel data.

As each node 102 detects objects, determines that the shape of the represented objects correspond to aerial vehicles, and computes bearings for the objects, node data that includes a timestamp, node identifier, and determined bearing(s) for each detected aerial vehicle are generated and sent through the network 150 from each node 102 to the air-traffic system 101.

The air-traffic system 101, upon receiving the node data from each node may determine from the bearings included in each node data the approximate position of each detected vehicle, provided the aerial vehicle is detected by two or more nodes. As discussed herein, the position of an aerial vehicle, or the approximate position of the aerial vehicle refers to the three-dimensions of the aerial vehicle position (e.g., latitude, longitude, altitude). For example and referring to FIG. 1C, the air-traffic system 101 may determine the approximate position of the first aerial vehicle 106-1 based on an intersection between the first bearing determined by the first node 102-1, the second bearing determined by the second node 102-2 and the fifth bearing determined by the fourth node 102-4. For example, if the sensors on the nodes include cameras, when the aerial vehicle 106-1 is in the field of view 112-1 of the first node 102-1 and the field of view 112-2 of the fourth node 102-4, the overlapping portion of those fields of view 160 may be provided as the approximate position of the aerial vehicle 106-1. Alternatively, if the sensors of the nodes include microphone arrays, a cone of uncertainty 112 for each node may be determined, with the size of cone of uncertainty expanding farther from the node, due to the speed of sound. In such an example, and again referring to FIG. 1C, for explanation purposes, the cone of uncertainty may be visually considered as similar to the fields of view 112-1, 112-2. Regardless of the type of sensor utilized, in some implementations, the approximate position may be an area, such as the overlapping area 160 of the fields of view/cones of uncertainty. In other implementations, the approximate position may be a specific position with an estimated error. The error may be estimated by the size of the overlapping area 160 of the fields of view 160, an offset between pixel data representative of the objects from the different sensors, etc., with a larger overlapping area corresponding to a larger potential error. As illustrated, the field of view/cone of uncertainty of the first node 102-1 and the fourth node 102-4 may expand as the distance from the node increases. As such, there is higher error potential the farther the detected aerial vehicle is from the node.

Likewise, the air-traffic system 101 may determine the approximate position of the second aerial vehicle 106-2 based on the third bearing determined by the third node and the fourth bearing determined by the fourth nodes 102-4.

As node data is continued to be received from each of the nodes over a period of time, each node data including bearings for detected aerial vehicles, the approximate positions of those aerial vehicles may be determined as they move through the area 108 and a trajectory of each aerial vehicle determined based on a series of determined approximate positions of those aerial vehicles. For example, and again referring to FIG. 1B, as node data with bearings for the first aerial vehicle 106-1 are received from nodes 102 and processed by the air-traffic system 101, it may be determined that the first aerial vehicle 106-1 is within area 108 and traveling with an eastward trajectory. In comparison, as node data with bearings for the second aerial vehicle 106-2 are received from nodes 102 and processed by the air-traffic system 101, it may be determined that the second aerial vehicle 106-2 is outside of the area 108 and traveling with a northern trajectory.

As discussed further below, in some implementations, the node data, determined trajectory, and/or historical flight information for an area may be used to determine a predicted path for an aerial vehicle. For example, based on the determined trajectory of the first aerial vehicle and historical data for other aerial vehicles that have traveled along the same trajectory, a predicted path may be determined that predicts that the first aerial vehicle 106-1 will continue in an easterly direction and then bank into a southern direction before existing the area 108. Prediction of aerial vehicle paths may be performed using one or more deep learning networks, such as a convolution neural network, that is trained with historical node data, trajectories, and/or path data of aerial vehicles through the area. Such a deep learning network, once trained, may receive as inputs node data, determined approximate aerial vehicle positions, and/or determined trajectories and produce as outputs predicted paths for those aerial vehicles.

As discussed further below, the air-traffic system 101 may also have one or more subscribing clients. A subscribing client may include, for example, the materials handling facility 104, one or more of the aerial vehicles 106-1, 106-2, other aerial vehicles, air-traffic control systems, third party systems, etc. In the example illustrated in FIGS. 1A and 1B the subscribing client includes the materials handling facility 104. In such an example, the material handling facility 104 has defined with the air-traffic system 101 a construct of nodes that includes nodes 102-1, 102-2, 102-3, 102-4 and an area 108 for which it desires to receive data regarding the position, trajectory, and/or predicted path of aerial vehicles within area 108. In such an example, because the first aerial vehicle is determined to be located within the area 108, the air-traffic system may provide information to the material handling facility 104 indicating the position of the first aerial vehicle 106-1, an alert that the aerial vehicle is within the area, and/or other information regarding the first aerial vehicle 106-1, such as the sound detected from the first aerial vehicle 106-1 and/or image data that includes pixel data representative of the aerial vehicle. In comparison, because the second aerial vehicle is determined to be outside of area 108, information regarding the second aerial vehicle 106-2 may not be provided to the material handling facility 104. The materials handling facility, operating as a subscribing client, may utilize the received information to, for example, ground all aerial vehicles from departing the material handling facility while the first aerial vehicle is located within the area 108, alter the navigation paths of aerial vehicles entering or exiting the area 108 to avoid the first aerial vehicle, etc.

In other implementations, the air-traffic system 101 may operate as, or correspond with, an air-traffic control system for detected aerial vehicles and provide navigation instructions to those aerial vehicles to cause the aerial vehicle(s) to alter paths as necessary to avoid other detected aerial vehicles.

Figure 2:
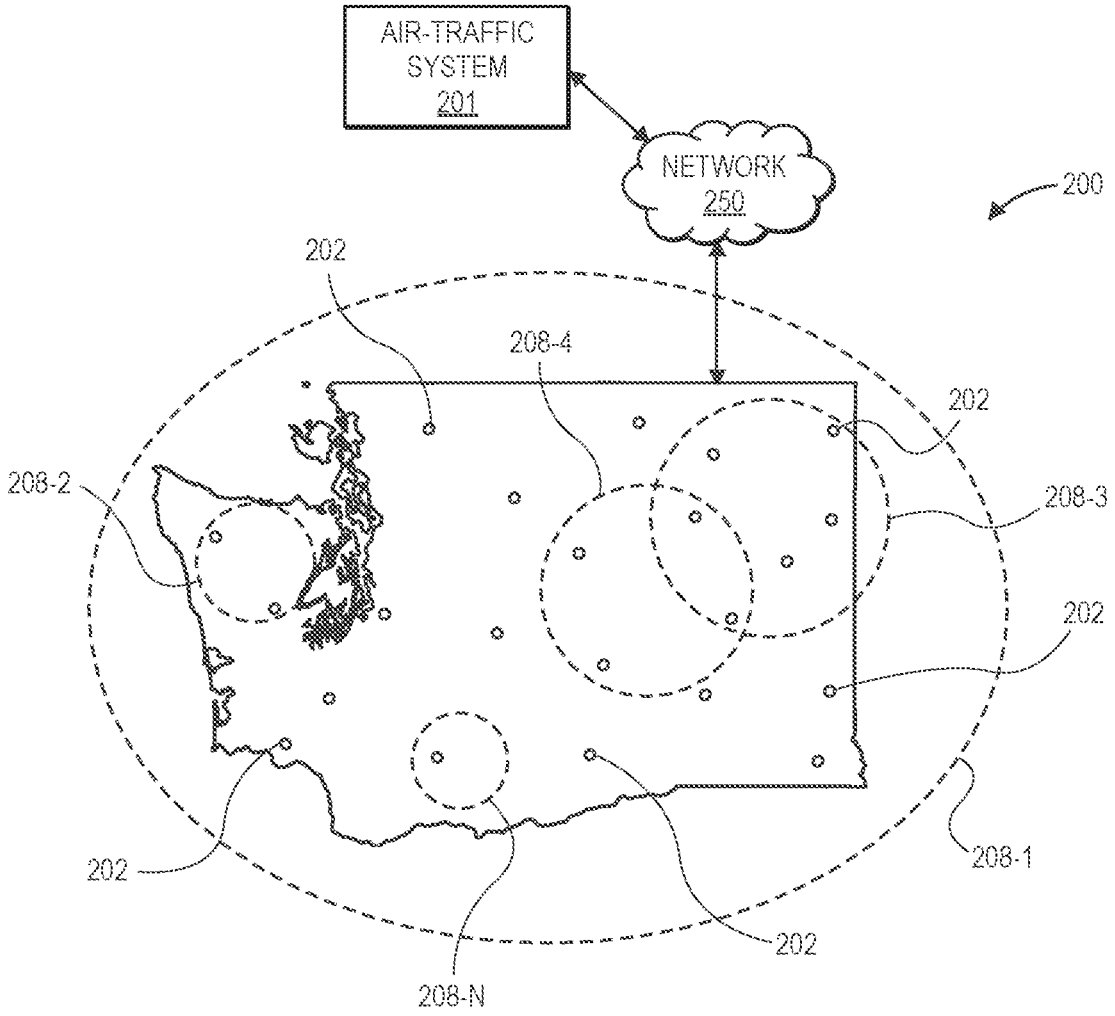
FIG. 2 illustrates an example system distributed over the state of Washington that is operable to track aerial vehicles operating in the Washington area, in accordance with disclosed implementations.

While the examples discussed with respect to FIGS. 1A through 1B relate to an area around a materials handling facility, in other implementations the system may cover a much larger area and include a much larger number of nodes. For example, FIG. 2 illustrates an example system 200 distributed over the state of Washington that is operable to track aerial vehicles operating in the Washington area, in accordance with disclosed implementations. As illustrated, the system 200 includes a plurality of nodes 202 distributed at different geographic locations that connect with and provide node data to, via one or more networks 250, an air-traffic system 201. Any number and type of node that is capable of detecting an aerial vehicle, determining a bearing toward the aerial vehicle, and providing node data that includes that bearing to the air-traffic system may be included in the system configuration 200. For purposes of discussion, the quantity of nodes represented in FIG. 2 is illustrative and not indented to correlate to the number of nodes that would be utilized to cover a larger area such as Washington state. For example, in some implementations, the described system in operation may include ten, twenty, thirty, forty, or more nodes within each ten-mile area.

Accordingly, for Washington state, the eighteenth largest state, with an area of approximately 71,362 square miles, the disclosed implementations may include hundreds of thousands of nodes (e.g., over 700,000 nodes or more) distributed across the state. In other implementations, there may be fewer nodes. Accordingly, the illustration presented in FIG. 2 is for explanation purposes only and not intended to be representative of the number of nodes utilized to cover a specific area.

Nodes may be grouped into one or more constructs 208 that may be maintained by the air-traffic system and one or more subscribing clients may subscribe to receive data relating to the one or more constructs. A construct of nodes may include any two or more nodes of the system 200 and may be of any shape or size. For example, construct 208-1 may include all nodes within Washington state, construct 208-2 may include nodes along a north-west portion of the state, construct 208-3 may include nodes in a north-east portion of the state, construct 208-4 may include nodes in a central portion of the state, and construct 208-N may include nodes along a southern portion of the state. As will be appreciated, any quantity and size of constructs of nodes may be established and maintained by the air-traffic system and any number of nodes may be included in a construct. Likewise, constructs, such as construct 208-3 and 208-4 may overlap, in whole or in part. Likewise, nodes 202 of the system may be associated with more than one construct. Constructs may be defined by the air-traffic system and/or by subscribing clients. Additionally, nodes may be added or removed from the system 200 and constructs may likewise be added or removed.

As discussed herein, aerial vehicle data for area vehicles operating in an area covered by one or more constructs may be provided to subscribing clients that subscribe to those one or more constructs. While the example illustrated in FIG. 2 indicates nodes distributed over the state of Washington and constructs existing within the state of Washington, in other implementations, the system may expand to cover multiple states, multiple cities, one or more continents, the entire globe, etc. Likewise, the constructs may be of any size and shape and may range from a small area, such as around a materials handling facility as illustrated in FIG. 1A, to towns, to cities, to counties, to states, to countries, to continents, etc., and different levels or types of information may be provided to different subscribing clients of those constructs. Likewise, as discussed further below, in some implementations, a first type of subscribing client may be allowed to select from existing constructs and/or define one or more new constructs by selecting one or more nodes, parameters, etc.

Figure 3:
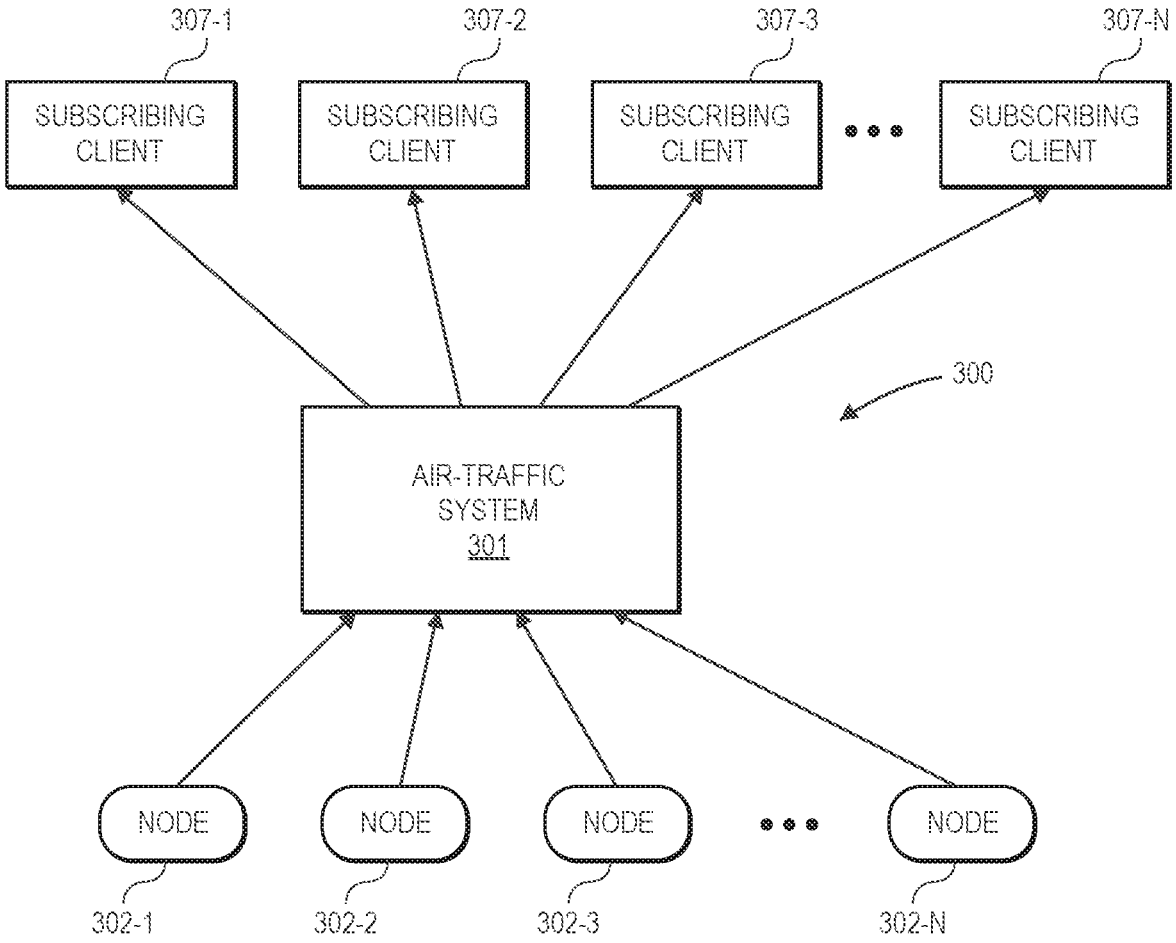
FIG. 3 is a block diagram illustrating an example air-traffic system configuration, in accordance with disclosed implementations.

FIG. 3 is a block diagram illustrating an example air-traffic system configuration 300, in accordance with disclosed implementations.

As illustrated, the air-traffic system 301 operates as a central control to which nodes 302 and subscribing clients 307 connect. As illustrated, there may be any number of nodes 302-1, 302-2, 302-3, through 302-N that connect with and provide node data to the air-traffic system. Likewise, there may be any number of subscribing clients 307-1, 307-2, 307-3, through 307-N that connect with the air-traffic system 301 and in some implementations the air-traffic system 301 may itself function as a subscribing client.

The air-traffic system may detect nodes 302 as they are added or removed from the system configuration 300, maintain a list of currently active nodes, and log when nodes are attached. When a new node connects to the air-traffic system, the node may provide identifying information to the air-traffic system 301. The identifying information for a node may include, but is not limited to, a node identifier (e.g., unique identifier), geographic location information (e.g., longitude/latitude, global coordinates, etc.), sensors included on the node, acoustical surroundings, etc. Likewise, when a node connects, provided that node has not previously connected, the air-traffic system may provide default configuration information that is used by the node. Default configuration information may include, but is not limited to, a frequency range for noise/sound detection using microphones, auto-exposure defaults for cameras, frame rate for cameras, audio/video compression settings, operating parameters (e.g., sound, elevation for detection limits), current software or firmware version, etc. In some implementations, the configuration information may also include one more test parameters that are performed by the node to determine the physical surroundings around the node and to determine whether portions or areas around the node should not be monitored (e.g., reflections of sounds, visual obstructions from buildings, trees, etc.). In some implementations, the node may also provide data to the air-traffic system such as, but not limited to, location, temperature, sensor type(s), software/firmware version, power source, etc.

Likewise, the air-traffic system may create and maintain constructs of nodes that may be defined by the air-traffic system and/or specified by one or more subscribing clients. Likewise, the air-traffic system may maintain a subscriber list for each construct of nodes and provide node data to subscribing clients of specific constructs. In some implementations, subscribing clients may specify the type, duration, and/or amount of data to be provided. For example, some subscribing clients may only request that data for a subscribed constructed be provided between 08:00 hours and 17:00 hours, while other subscribing clients may specify that data for the same construct is to be provided continuously. As another example, some subscribing clients may request the type of data to be provided. For example, some subscribing clients may request alerts or event notifications when an aerial vehicle is detected within a construct. As another example, some subscribing clients may request to receive raw data generated by the nodes that was used to detect the aerial vehicle (e.g., sound data, image data), aerial vehicle type, etc.

The air-traffic system 301 may also process node data received from each of the nodes using one or more algorithms to determine the approximate position of aerial vehicles detected by those nodes, the trajectory of those aerial vehicles, the type of aerial vehicle based on the detected sound and/or the size/shape of the detected object, and/or the predicted path of those aerial vehicles. The algorithms used by the air-traffic system may include, but are not limited to aggregation, federation and reinforcement, intersection, triangulation, computation of range, bearing, altitude, aerial vehicle type, approach vector (speed and direction), tracking over time, and/or predictive algorithms to compute predicted paths of the aerial vehicles.

The data generated by the air-traffic system 301 may be exposed or otherwise made available or disseminated to subscribing clients. In some examples, subscribing clients may be facilities (or facility managers), such as hospitals, materials handling facilities, governments, etc. In other examples, subscribing clients may include air-traffic control systems that provide navigation information to aerial vehicles. In some implementations, alarms, alerts, triggers, or other notifications may be defined for a construct. For example, a subscribing client may specify that an alarm or other notification is to be trigged when an aerial vehicle is detected as entering an area covered by a construct of nodes, that position data for the aerial vehicle is to be reported every five seconds while the aerial vehicle is in the area covered by the construct, and that the alarm is to be cleared when the aerial vehicle exits the area covered by the construct. Any number and/or type of alarm, alert, trigger, etc., may be defined for any one or more constructs and/or subscribing clients.

In still other examples, the air-traffic system itself may operate as an air-traffic control system and the subscribing clients may include some or all of the aerial vehicles. For example, the air-traffic system may detected the approximate position of aerial vehicles, the trajectory of aerial vehicles, and/or the predicted path of those aerial vehicles and provide alternative paths to some or all aerial vehicles so that each of the aerial vehicles maintain a safe distance from other aerial vehicles. In other examples, the air-traffic system may provide approximate position, trajectory, and/or predicted path information of detected aerial vehicles directly to aerial vehicles so that the aerial vehicles can determine and adjust paths accordingly to maintain safe operating distances. In such examples, the aerial vehicles may be considered subscribing clients.

In addition to providing data to subscribing clients, as node data is received and processed, the node data, processed data, etc., may be maintained in one or more data stores by the air-traffic system. The stored data may then be recalled by the air-traffic system, subscribing clients, etc., to re-create events that have occurred, may be used to train a machine learning algorithm that is used to predict paths of aerial vehicles, etc.

Figure 4:
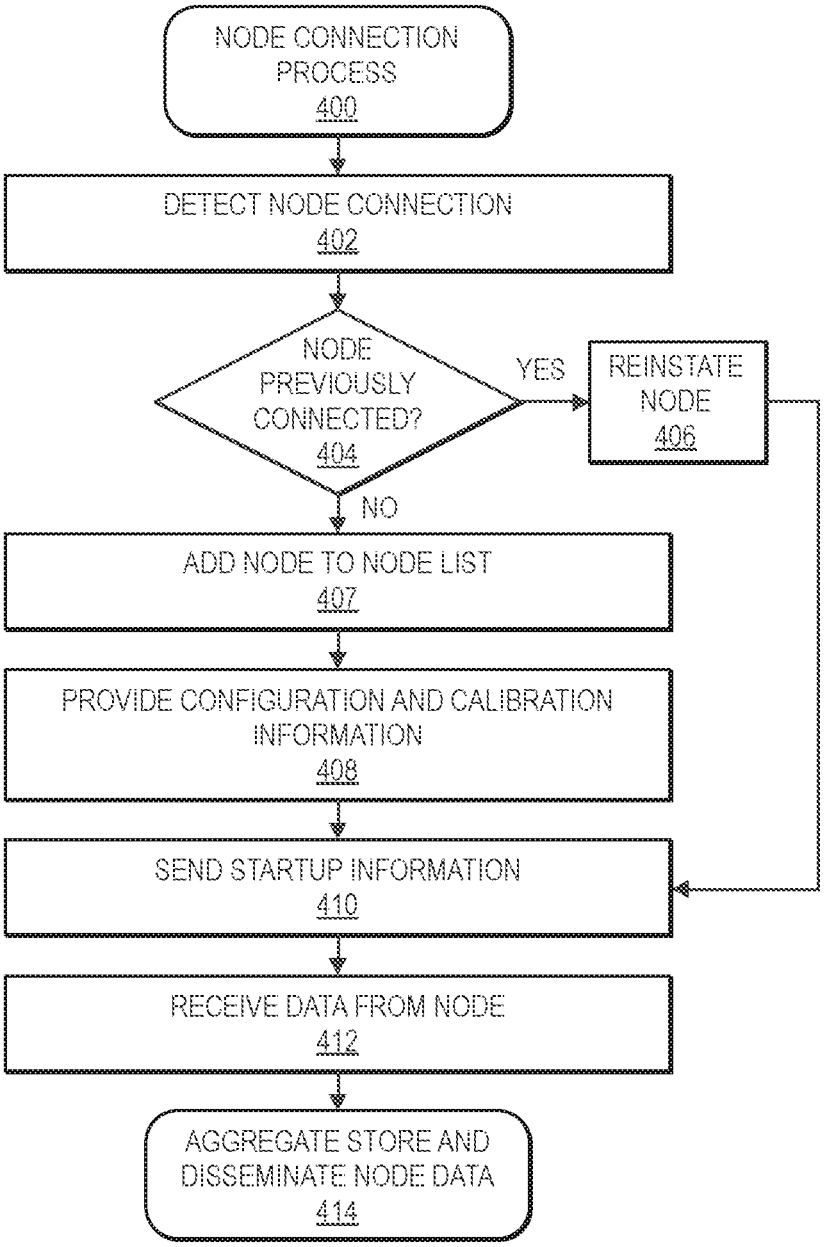
FIG. 4 is an example node connection process, in accordance with disclosed implementations.

FIG. 4 is an example node connection process 400, in accordance with disclosed implementations.

The example process 400 begins when the air-traffic system detects a connection from a node, as in 402. For example, when a node is powered up and connected to a network, the node may send out a connection request that is received by the air-traffic system. The connection request may include, among other information, a node identifier and geographic location information about the node.

Upon detecting the connection, a determination is made as to whether the connecting node has previously connected to the air-traffic system, as in 404. If it is determined that the node has previously connected, the node is reinstated with its already established configuration, as in 406. As discussed above, the air-traffic system may maintain information and/or configuration data for nodes that are connected to the system. When a node that has previously connected reconnects, the prior configuration data may be used and/or again provided to the node and the node reinstated. Alternatively, if some or all of the node data for a previously connected node is out of date (e.g., the firmware is no longer current), some or all of the configuration data may be updated before the node is reinstated.

If the connecting node has not previously connected to the air-traffic system, the node identifier of the node is added to a node list, as in 407, and configuration and calibration data is sent to the node, 408. Configuration and calibration data may include, but is not limited to, a frequency range for noise/sound detection, auto-exposure defaults for cameras, frame rate for cameras, audio/video compression settings, operating parameters (e.g., sound, elevation for detection limits), current software or firmware version, etc. In some implementations, the calibration data may also include one more test parameters that are performed by the node to determine the physical surroundings around the node and to determine whether portions or areas around the node should not be monitored (e.g., reflections of sounds, visual obstructions from buildings, trees, etc.). Those tests may be performed by the node and used to calibrate the surroundings around the node. Those calibrations may be maintained as part of the configuration of the node. In some implementations, the node may also provide data to the air-traffic system such as, but not limited to, location of the node, temperature at the node, sensor type(s), software/firmware version, power source, etc.

Once the node has been configured and calibrated, a startup instruction or startup information is sent to the node to initiate the node so that node data can be collected by the node and sent to the air-traffic system, as in 410. The startup information may include, for example, a timing clock notifier that is used to set the clock of the node with the clock of the air-traffic system and other nodes within the system configuration so that node data from all nodes is based on a common clock and timestamps.

Once as node has been started, the node begins sending node data, as discussed herein, and the node data is received by the air-traffic system, as in 412. As node data is received, the node data is aggregated and/or processed, as in 414. Processing and/or aggregating of node data is discussed throughout the application and not repeated here.

Figure 5:
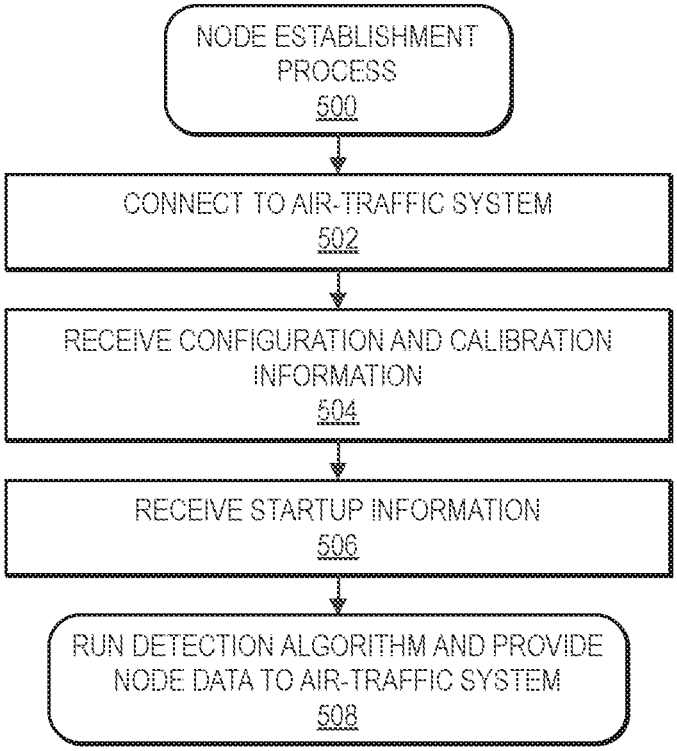
FIG. 5 is an example node establishment process, in accordance with disclosed implementations.

FIG. 5 is an example node establishment process 500, in accordance with disclosed implementations. The example process 500 may be performed by a node when joining the system configuration.

The example process 500 begins when the node is powered up and connects to the air-traffic system as discussed above with respect to FIG. 4, as in 502. Once the node is connected to the air-traffic system, the node receives configuration and calibration data from the air-traffic system, as in 504. If the node has not previously connected to the system, it may receive default configuration and calibration information. If it has previously connected to the system, the node may receive a prior calibration and configuration information for the node and/or receive an indication of a prior calibration and/or configuration for use that is maintained by the node.

In addition to receiving configuration and calibration information and once the node is joined to the system configuration, the node will receive startup instructions or startup information notifying the node that it is to begin monitoring for aerial vehicles and generating node data in response to detection of an aerial vehicle, as in 506.

Finally, once started and during the time the node is connected and active, the node monitors for aerial vehicles and sends node data to the air-traffic system, as in 508. As discussed, if the node includes a microphone array, the node may be tuned to detect low frequency noises generated by motors of aerial vehicles that typically operate below 500 feet. When the node detects a noise, it determines if the noise is representative of an aerial vehicle and, if so, generates a bearing in the direction of a source of the noise. As another example, if the node includes one or more cameras as the sensors, image data generated by the cameras may be processed at the node to determine objects represented by pixels in the image data and a determination made as to whether the shape and/or size of the object correspond to an aerial vehicle. If it is determined that the object is representative of an aerial vehicle, the node data generates a bearing in the direction of the object. Regardless of the type of sensor used or the data processed, when a bearing is determined, the bearing is included in the node data and sent to the air-traffic system. This process may continue on defined time intervals (e.g., every five second, 10 seconds, etc.) and node data generated each time an aerial vehicle is detected, and a bearing determined. In other examples, the node may continually monitor for aerial vehicles and generate bearings, but only send node data at defined intervals. For example, detection and bearings may be computed every second but node data may only be transmitted every five seconds. In such an implementation, the node data may include all bearings generated by the node since a last node data transmission. If no bearings are detected between transmissions, the node data may include a null set, which is informative to the air-traffic system to confirm that the node is active and that no aerial vehicles have been detected by the node. In still other examples, each node of the system may periodically send to the air-traffic system a notification at defined intervals to indicate that the node is still active. If node data is generated the node data may be appended to a next notification that is sent by the node to the air-traffic system.

In other implementations, the node may send all detected noises/sounds as sound data, and/or generated image data, to the air traffic system and the air traffic system may process the sound data/image data to determine whether the sound/image corresponds to or represents an aerial vehicle or not, a type of aerial vehicle determined from the sound data/image data, etc.

Figure 6:
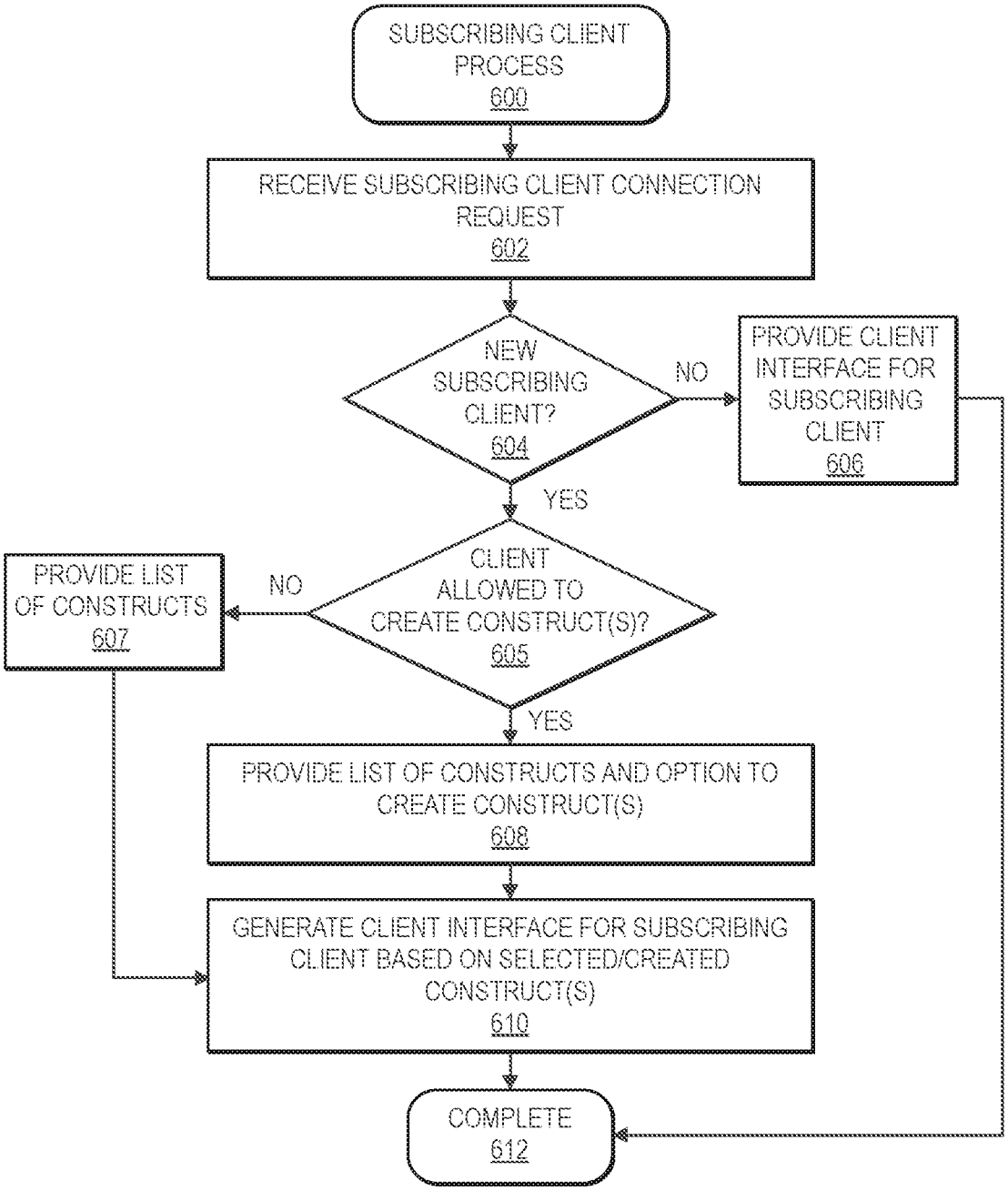
FIG. 6 is an example subscribing client process, in accordance with disclosed implementations.

FIG. 6 is an example subscribing client process 600, in accordance with disclosed implementations. As discussed above, any number and/or type of entity may be a subscribing client that subscribes to receive data and/or information from the air-traffic system, in accordance with disclosed implementations.

The example process 600 begins upon receipt of a subscribing client connection request, as in 602. For example, a subscribing client may access the air-traffic system via a network interface, such as a graphical user interface, an Application Programming Interface ("API"), etc.

Upon receiving a subscribing client connection request, a determination is made as to whether the subscribing client is a new subscribing client, as in 604. If it is determined that the subscribing client is not a new subscribing client (i.e., the subscribing client has previously accessed the air-traffic system), a client interface and/or configuration that has previously been established based on the type of subscribing client, preferences of the subscribing client, and/or constructs selected or created by the subscribing client is provided to the subscribing client, as in 606. If it is determined that the subscribing client is a new subscribing client, a determination is made as to whether the subscribing client is allowed to create constructs, as in 605. In some implementations, a first type of subscribing client, also referred to herein as a user subscribing client, may only be allowed to select existing constructs and optionally specify parameters for which data from the selected construct is to be provided to the subscribing client. In comparison, a second type of subscribing client, also referred to herein as an administrative subscribing client, may be allowed to both select from existing constructs and/or create constructs through selection of two or more nodes. If it is determined that the subscribing client is allowed to create constructs, a list or graphical presentation of existing constructs is presented to the new subscribing client along with an option for the subscribing client to create one or more new constructs, as in 608. For example, an operator may be presented with a graphical presentation of nodes that may be selected by the subscribing client to define a construct. The subscribing client may also select an area to be covered by the construct or select to cover as much area as possible through the selected nodes to include in the construct. Still further, the administrator subscribing client may also select the type of information, alarms, notifications, actions to be performed, etc., that are to be provided to the client when aerial vehicles are detected by the construct.

If it is determined that the subscribing client is not allowed to create constructs, a list or graphical presentation of existing constructs is presented to the new subscribing client without the option to create a construct, as in 607. In some implementations, the user subscribing client may be allowed to select the type of information, alarms, notifications, actions to be performed, etc., that are to be provided to the user subscribing client when aerial vehicles are detected by the selected construct.

Once the client has selected or defined one or more constructs, a client interface may be created for the client based on the selected and/or created constructs, as in 610. The interface may be used to provide information to the subscribing client, allow the subscribing client to add, remove, and/or change constructs, receive real-time data generated by the air-traffic system, review historical data stored by the air-traffic system, etc.

Upon generating and/or providing a client interface to the subscribing client at blocks 610 or 606, the example process 600 completes, as in 612.

Figure 7:
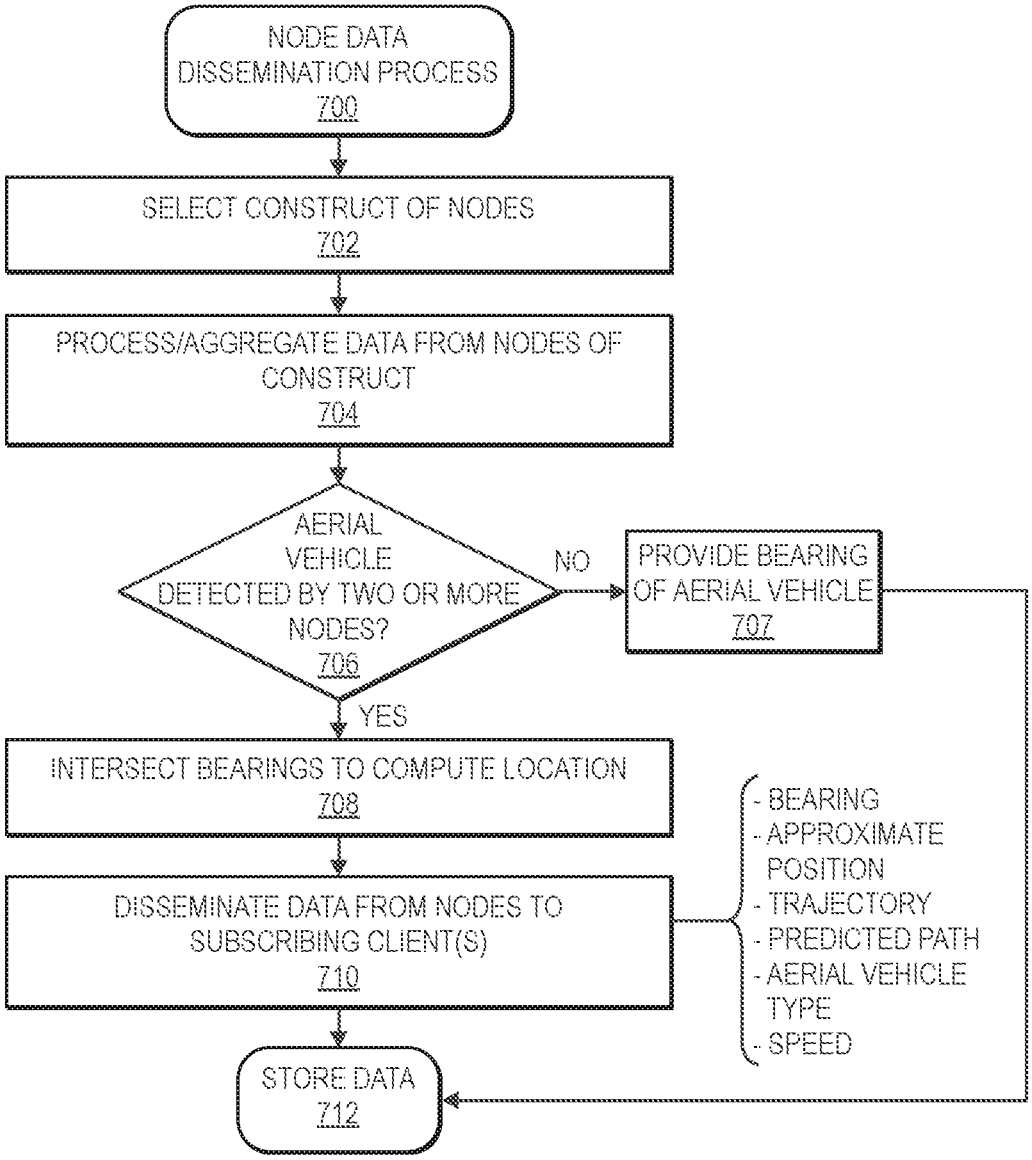
FIG. 7 is an example node data dissemination process, in accordance with disclosed implementations.

FIG. 7 is an example node data dissemination process 700, in accordance with disclosed implementations.

The example process 700 begins by selecting a construct of nodes, as in 702. For the selected construct of nodes, data received from nodes included in the construct are processed and/or aggregated to determine any aerial vehicles detected by the nodes, as in 704.

For the processed and/or aggregated data, a determination is made as to whether an aerial vehicle has been detected by two or more nodes of the construct, as in 706. If it is determined that two or more nodes of the construct have not detected the aerial vehicle (i.e., only one node detected the aerial vehicle) the bearing toward the aerial vehicle as detected by the single node may be provided to subscribing clients of the construct, as in 707. In some implementations, the bearing to the aerial vehicle may only be provided to subscribing clients that request to receive bearing information. In other implementations, the bearing may not be provided.

If it is determined that two or more nodes detected an aerial vehicle, the bearing determined by each detecting node are intersected and the intersection point is used to determine an approximate position of the aerial vehicle, as in 708. The approximate position of the aerial vehicle may represent a range or area around the intersection of the two bearings. The size of the area or range may be determined based on, for example, the number of bearings intersected, the distance between the nodes and the determined intersection, the size of the overlapping fields of view/cone of uncertainty, as discussed above with respect to FIG. 1C, etc. For example, if the intersection is close to one or more nodes and/or multiple nodes provided bearings, the error may be small and thus, the size of the approximate position small. If the intersection is far from all nodes, the error may be larger and thus the size of the approximate position larger. The air-traffic may also compare or consider the signals determined from the node data in determining error and/or the timing at which the aerial vehicles are detected. For example, if the node data includes sound data detected from the node, the sound data from each node that detected the aerial vehicle may be compared to determine if the signature of the aerial vehicle in the sound data from those nodes are similar. Likewise, if the node data includes image data generated by a camera of the node, the image data from each node may be compared to determine if the size/shape of the aerial vehicle in the sound data for those nodes are similar. In still another example, if one of the nodes provides a first bearing for the aerial vehicle based on sound data and another node provides a second bearing for the aerial vehicle based on image data, the air-traffic system may determine a type of the aerial vehicle based on the signature of the aerial vehicle in the sound data and determine a type of the aerial vehicle based on the size/shape of the object in the image data, and compare those types to determine if the bearings in the respective node data correspond to the same aerial vehicle.

The computed approximate position of each aerial vehicle detected by two or more of the nodes of the construct are then provided to the subscribing clients of the construct, as in 710. Alternatively, or in addition thereto, any defined alarms, alerts, notification, or other actions or information may also be provided to subscribing clients of the construct. For example, a subscribing client may establish an alert that is sent to the subscribing client any time an aerial vehicle is detected within the area of the construct. Other information that may be provided to a subscribing client may include, but is not limited to, the bearing of the aerial vehicle, the trajectory of the aerial vehicle, the speed of the aerial vehicle, the determined type of the aerial vehicle, etc.

In some implementations, the air-traffic system may also function as an air-traffic control system and utilize the information provided by the example process 700 to determine if other one or more aerial vehicles need to alter paths to continue operating at safe distances from other aerial vehicles.

Figure 8:
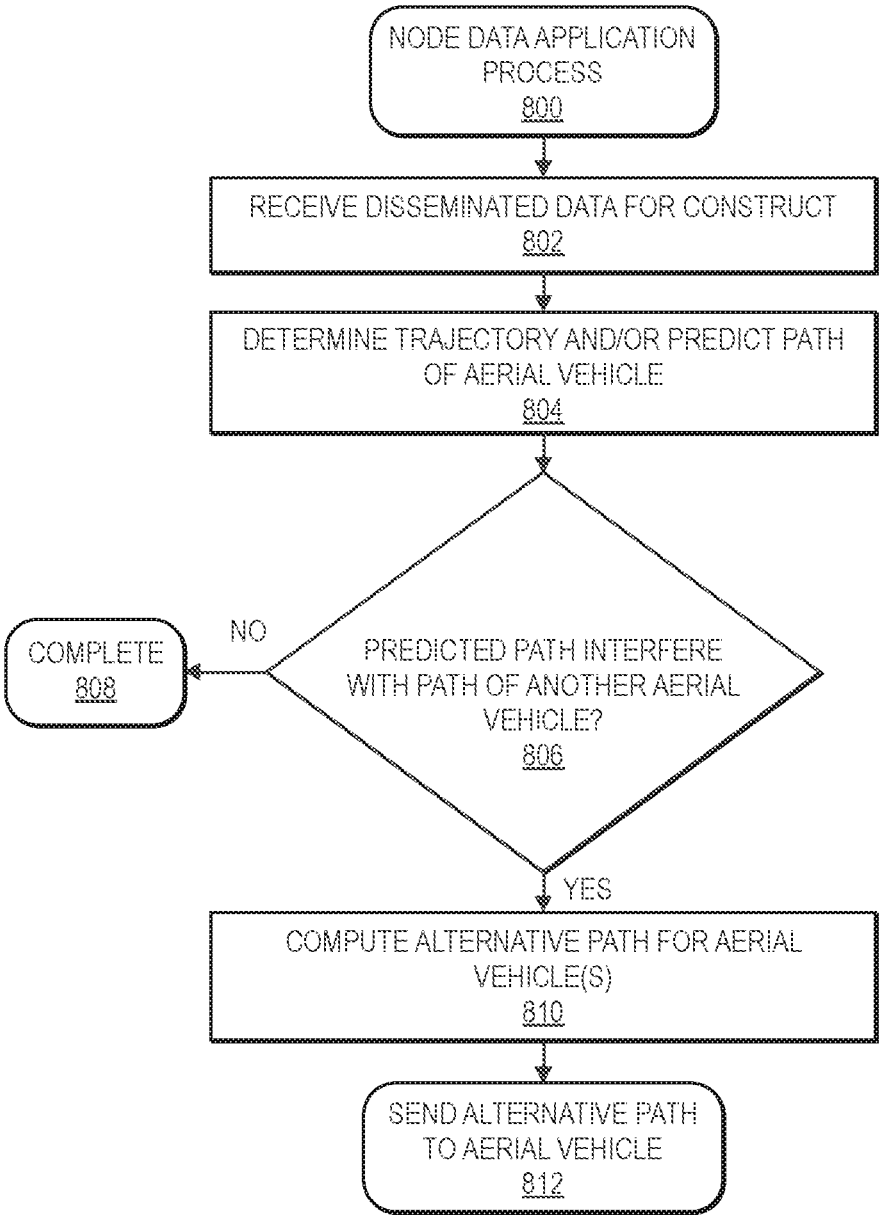
FIG. 8 is an example node data application process, in accordance with disclosed implementations.

For example, FIG. 8 is an example node data application process 800, in accordance with disclosed implementations. The example process may be performed by a subscribing client of the air-traffic system. For example, the subscribing client may be the air-traffic system operating as an air-traffic control system for the area, a third-party air-traffic control system, an aerial vehicle, etc.

The example process receives the disseminated data for a construct that is generated and sent by the example process 700, as in 802. In the illustrated example, based on the received approximate position of the detected aerial vehicle (s), a trajectory and/or predicted path of each vehicle detected within the construct may be determined, as in 804. For example, approximate position information for one or more aerial vehicles may be provided by the example process periodically over a defined period of time. Because aerial vehicles are typically moving, a series of approximate positions may be used to determine a trajectory of the aerial vehicle. Likewise, in some implementations, the series of approximate positions and/or trajectory of an aerial vehicle may be used to determine a predicted path of the aerial vehicle. For example, the approximate positions and/or trajectory of an aerial vehicle may be provided to a trained deep neural network, as discussed above, and the deep neural network may provide as an output a predicted path of the aerial vehicle within the area covered by the construct.

Based on the predicted path of the aerial vehicle(s) within the area of the construct, a determination is made as to whether any of the predicted paths interfere with any other predicted paths or planned paths of other aerial vehicles, as in 806. A planned path may correspond to an aerial vehicle that is under control of a system that is performing the example process 800 and/or that has reported or provided path information. Likewise, it may be determined that paths interfere if they may result in two or more aerial vehicles exceeding a minimum operating distance of each other. The minimum operating distance may vary for different vehicles, different altitudes, different areas, different constructs, etc. In one example, the minimum operating distance may be three-hundred feet in the horizontal direction and fifty feet in the vertical direction. In other implementations, the minimum operating distance may be higher or lower. Likewise, while this example has different minimum operating distances for vertical and horizontal directions, in other implementations, the minimum operating distances for vertical and horizontal may be the same or a single minimum operating distance may be utilized.

If it is determined that there are paths that potentially interfere with paths of other aerial vehicles, the example process 800 completes, as in 808. However, if it is determined that a predicted path of an aerial vehicle does interfere with a path of another aerial vehicle, the example process computes an alternative path for one or more of the aerial vehicles, as in 810. For example, if the system executing the example process 800 provides air-traffic control for both aerial vehicles, the system may determine alternative paths for one or both of the vehicles. If the system performing the example process 800 only has the ability to control operation of one of the aerial vehicles, an alternative path for that aerial vehicle may be determined.

Finally, the alternative path computed for the one or more aerial vehicles is provided to the one or more aerial vehicles for execution, as in 812.

While the example discussed above with respect to FIG. 8 describes a system computing and sending alternative paths to one or more aerial vehicles, in other implementations, the approximate positions, trajectories, and/or predicted paths may be provided directly to aerial vehicles operating in the area of the construct and the aerial vehicle(s) may determine an alternative path. In still other examples, only approximate positions of other aerial vehicles within the construct may be provided to an aerial vehicle and the aerial vehicle may determine trajectories and/or predicted paths of those other aerial vehicles and, if needed, determine and follow an alternative path to remain a safe operating distance from those other aerial vehicles.

Figure 9:
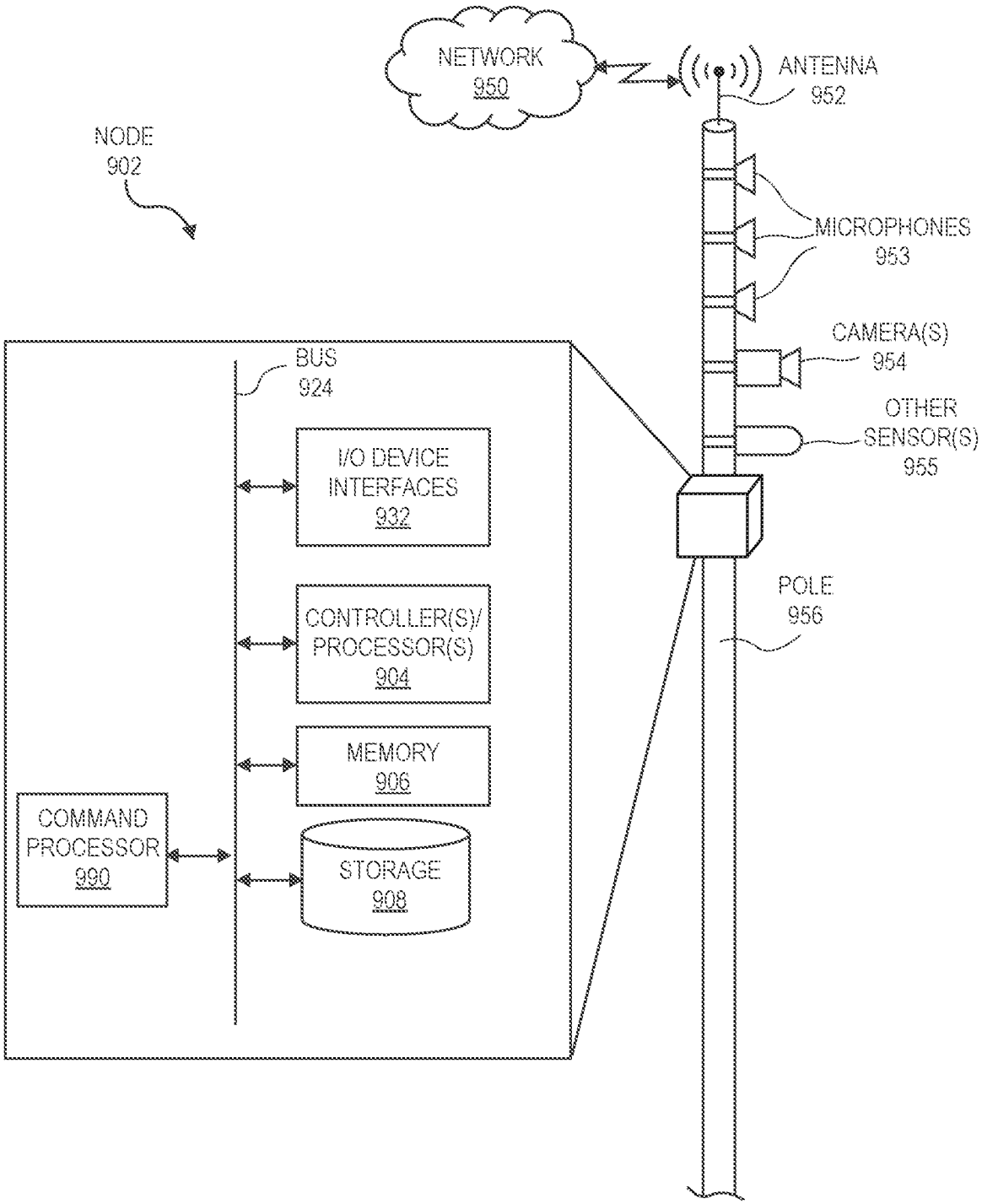
FIG. 9 illustrates example components of a node, in accordance with described implementations.
Figure 10:
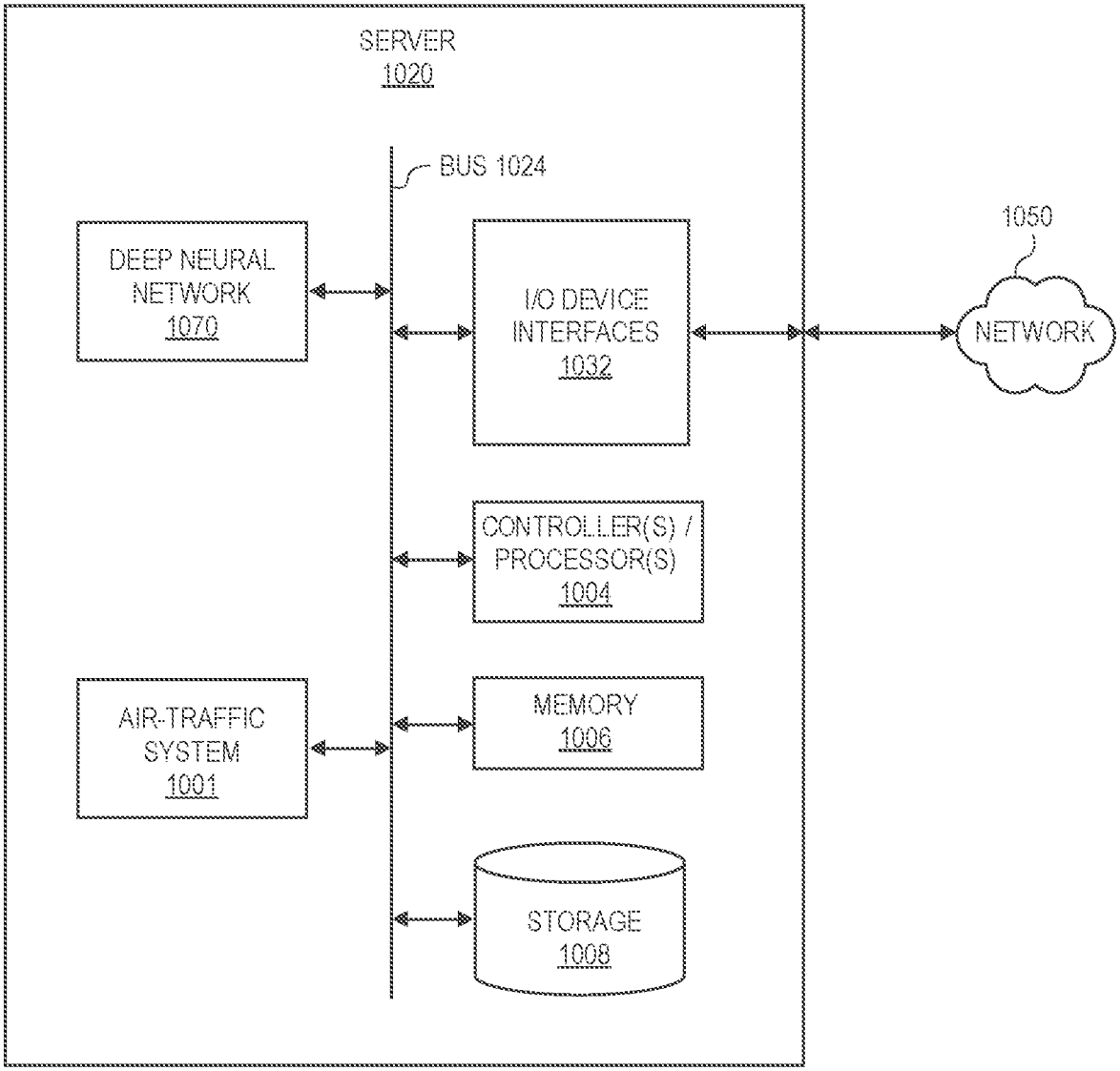
FIG. 10 illustrates example components of a server, in accordance with described implementations.

FIG. 9 is a block diagram conceptually illustrating a node 902 that may be used with the described implementations. FIG. 10 is a block diagram conceptually illustrating example components of a remote computing device, such as a remote server 1020 that may include and/or execute one or more components of the air-traffic system, in accordance with described implementations. Multiple such servers 1020 may be included in the system, such as one server(s) 1020 for receiving node data from a node 902, one server for processing the received node data, one server for receiving and defining constructs of nodes for one or more subscribing clients, one server for generating data for a construct, one server for determining alternative paths for aerial vehicles, etc. In operation, each of these devices (or groups of devices) may include computer-readable and computer-executable instructions that reside on the respective device (902/1020), as will be discussed further below.

Each of these devices (902/1020) may include one or more controllers/processors (904/1004), that may each include a central processing unit (CPU) for processing data and computer-readable instructions, and a memory (906/1006) for storing data and instructions of the respective device. The memories (906/1006) may individually include volatile random access memory (RAM), non-volatile read only memory (ROM), non-volatile magnetoresistive (MRAM) and/or other types of memory. Each device may also include a data storage component (908/1008), for storing data, controller/processor-executable instructions, node information, node data, construct information, aerial vehicle paths, etc. Each data storage component may individually include one or more non-volatile storage types such as magnetic storage, optical storage, solid-state storage, etc. Each device may also be connected to removable or external non-volatile memory and/or storage (such as a removable memory card, memory key drive, networked storage, etc.) through respective input/output device interfaces (932/1032).

Computer instructions for operating each device (902/1020) and its various components may be executed by the respective device's controller(s)/processor(s) (904/1004), using the memory (906/1006) as temporary "working" storage at runtime. A device's computer instructions may be stored in a non-transitory manner in non-volatile memory (906/1006), storage (908/1008), or an external device(s). Alternatively, some or all of the executable instructions may be embedded in hardware or firmware on the respective device in addition to or instead of software.

Each device (902/1020) includes input/output device interfaces (932/1032). A variety of components may be connected through the input/output device interfaces. Additionally, each device (902/1020) may include an address/data bus (924/1024) for conveying data among components of the respective device. Each component within a device (902/1020) may also be directly connected to other components in addition to (or instead of) being connected to other components across the bus (924/1024).

Referring to the node 902 of FIG. 9, the node 902 may include input/output device interfaces 932 that connect to a variety of components such as one or more cameras 954, one or more microphones 953, and/or other sensors 955. In one implementation, the device may include an array of microphones 953 (e.g., two, three, four, five, or more microphones) mounted on a pole 956 and spaced apart by a known distance. The microphones 953, in conjunction with the command processor 990 and/or memory, may be tuned to detect the low frequency (e.g., 60-200 Hertz) that is typical of small aerial vehicle motors (e.g., propeller planes, Cessna airplanes, helicopters, unmanned aerial vehicles, etc.). Using an array of microphones with the node 902 allows detection of aerial vehicle noises that are processed in real-time or near real-time to determine a bearing toward a source of the detected sound (i.e., aerial vehicle). As discussed above, a bearing may include an azimuth and an elevation of the aerial vehicle with respect to a position of the node 902.

The nodes 902 may also include other sensors 955 that collect sensor data that may be representative of an aerial vehicle. Any number and/type of sensors may be included and/or connected to the I/O device interface 932 of the node 902. In the illustrated example, in addition to the microphones 953, the nodes 902 includes one or more cameras 954 and/or other sensors 955.

The nodes 902 may also include a communication interface, such as an antenna 952. Any form of wired and/or wireless communication may be utilized to facilitate communication between the node 902 and server 1020 and/or air-traffic system. For example, any one or more of 802.15.4 (ZIGBEE), 802.11 (WI-FI), 802.16 (WiMAX), BLUETOOTH, Z-WAVE, near field communication ("NFC"), cellular, etc., may be used to communicate between the nodes 902 and the server/air-traffic system 1020/1001. For example, via the antenna(s), the node 902 and server 1020 may connect to one or more networks 950/1050 via a wireless local area network (WLAN) (such as Wi-Fi) radio, Bluetooth, and/or wireless network radio, such as a radio capable of communication with a wireless communication network such as a Long-Term Evolution (LTE) network, WiMAX network, 3G network, etc. A wired connection such as Ethernet may also be supported.

The node 902 and/or server 1020 may also include a command processor 990 that is configured to execute commands/functions such as processing acoustic data received by the microphones 953 to determine a bearing to an aerial vehicle, process received node data from multiple nodes to determine a position, trajectory, and/or predicted path of an aerial vehicle, etc.

The server may also include a deep neural network 1070, such as a CNN. As discussed above, the deep neural network 1070 may receive node data and historical flight path information for an area and determine a predicted path of a current aerial vehicle as the aerial vehicle is detected by one or more of the nodes 902.

The components of the nodes 902 and server 1020, as illustrated in FIGS. 9 and 10, are exemplary, and may be located as a stand-alone device or may be included, in whole or in part, as a component of a larger device or system.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers, communications, audio processing, and aerial vehicle monitoring should recognize that components and process steps described herein may be interchangeable with other components or steps, or combinations of components or steps, and still achieve the benefits and advantages of the present disclosure. Moreover, it should be apparent to one skilled in the art that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage media may be implemented by a volatile computer memory, non-volatile computer memory, hard drive, solid-state memory, flash drive, removable disk and/or other media. In addition, components of one or more of the modules and engines may be implemented in firmware or hardware.

Unless otherwise explicitly stated, articles such as "a" or "an" should generally be interpreted to include one or more described items. Accordingly, phrases such as "a device configured to" or "a device operable to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A system, comprising:

a plurality of nodes, each node at a different geographic location within an area, wherein each node includes at least a microphone array of a plurality of microphones and is operable to at least:

detect, with each of the plurality of microphones of the microphone array, a sound of an aerial vehicle; and determine, based at least in part on the sound of the aerial vehicle detected by each of the plurality of microphones of the microphone array, a bearing to the aerial vehicle; and an air-traffic system executing on one or more computing systems and operable to at least:

receive, from each of the plurality of nodes, node data that includes the bearing to the aerial vehicle;

determine, based at least in part on node data received from two or more nodes of the plurality of nodes, an approximate position of the aerial vehicle;

provide, to one or more subscribing clients, the approximate position of the aerial vehicle;

receive subscriber information from a subscribing client, wherein the subscriber information includes an indication of a second plurality of nodes to include in a construct of nodes for the subscribing client, wherein the second plurality of nodes includes nodes from the plurality of nodes;

determine, based on node data from nodes indicated in the construct of nodes, a second approximate position of a second aerial vehicle; and provide, to the subscribing client, the second approximate position of the second aerial vehicle.

2. The system of claim 1, wherein the air-traffic system is further operable to at least:

receive, from each of the plurality of nodes, and over a period of time, node data; and determine, from node data received from at least two nodes and during the period of time, a trajectory of the aerial vehicle.

3. The system of claim 1, wherein the air-traffic system is further operable to at least:

receive, from each of the plurality of nodes, and over a period of time, node data; and determine, using a deep neural network and based at least in part on node data received from at least two nodes during the period of time, a predicted path of the aerial vehicle.

4. The system of claim 1, wherein the air-traffic system is further operable to at least:

determine, for the second aerial vehicle in the area and based at least in part on the approximate position of the aerial vehicle, an altered path for the second aerial vehicle; and send, to the second aerial vehicle, the altered path to cause the second aerial vehicle to navigate according to the altered path.

5. A computing system, comprising:

one or more processors; and a memory storing program instructions that when executed by the one or more processors cause the one or more processors to at least:

receive subscriber information from a first subscribing client, wherein the subscriber information includes an indication of a first plurality of nodes to include in a first construct of nodes for the first subscribing client, wherein the first plurality of nodes includes a first node and a second node from a plurality of nodes;

receive, from the first node, first node data that includes a first bearing of an aerial vehicle detected by the first node;

receive, from the second node that is at a different geographic location than the first node, second node data that includes a second bearing of the aerial vehicle detected by the second node;

determine, based at least in part on the first node data and the second node data, an approximate position of the aerial vehicle; and provide, to the first subscribing client, the approximate position of the aerial vehicle.

6. The computing system of claim 5, wherein:

the first bearing includes a first azimuth and a first elevation of the aerial vehicle with respect to the first node; and the second bearing includes a second azimuth and a second elevation of the aerial vehicle with respect to the second node.

7. The computing system of claim 6, wherein the program instructions, when executed by the one or more processors, further cause the one or more processors to at least:

determine the approximate position of the aerial vehicle based at least in part on an intersection between the first bearing and the second bearing.

8. The computing system of claim 5, wherein the program instructions, when executed by the one or more processors, further cause the one or more processors to at least:

detect a connection request from a third node, wherein the connection request indicates at least:

an identifier of the third node; and a geographic location of the third node;

determine that the third node has not previously connected;

provide configuration information and calibration information to the third node;

receive third node data from the third node; and determine, based at least in part on the first node data, the second node data, and the third node data, the approximate position of the aerial vehicle.

9. The computing system of claim 5, wherein:

the first node data includes a first plurality of bearings of the aerial vehicle as detected by the first node over a period of time, wherein the first plurality of bearings includes the first bearing;

the second node data includes a second plurality of bearings of the aerial vehicle as detected by the second node over the period of time, wherein the second plurality of bearings includes the second bearing; and the program instructions, when executed by the one or more processors, further cause the one or more processors to at least:

determine, based on the first node data and the second node data, a plurality of approximate positions of the aerial vehicle over the period of time, wherein the plurality of approximate positions includes the approximate position of the aerial vehicle; and determine, based at least in part on the plurality of approximate positions, a trajectory of the aerial vehicle.

10. The computing system of claim 9, wherein the program instructions, when executed by the one or more processors, further cause the one or more processors to at least:

determine, based at least in part on the trajectory of the aerial vehicle, an altered path for a second aerial vehicle so that the altered path of the second aerial vehicle does not intersect with the trajectory of the aerial vehicle; and send, to a subscribing client, the altered path for the second aerial vehicle.

11. The computing system of claim 10, wherein the subscribing client is the second aerial vehicle.

12. The computing system of claim 10, wherein the subscribing client is an air-traffic system that provides instructions to the second aerial vehicle.

13. The computing system of claim 9, wherein the program instructions, when executed by the one or more processors, further cause the one or more processors to at least:

determine, based at least in part on one or more of the first node data, the second node data, the trajectory, or historical node data, a predicted path of the aerial vehicle.

14. The computing system of claim 5, wherein the program instructions, when executed by the one or more processors, further cause the one or more processors to at least:

receive subscriber information from a second subscribing client, wherein the subscriber information includes an indication of a second plurality of nodes to include in a second construct of nodes for the second subscribing client, wherein the second plurality of nodes includes at least one of the first node or the second node from the plurality of nodes;

determine, based on node data from nodes indicated in the second construct, a second approximate position of a second aerial vehicle; and provide, to the second subscribing client, the second approximate position of the second aerial vehicle.

15. A computer-implemented method, comprising:

receiving, from a first subscribing client, subscriber information that includes an indication of a first plurality of nodes to include in a first construct of nodes for the first subscribing client, wherein the first plurality of nodes includes a first node and a second node from a plurality of nodes;

receiving, from the first node, first node data that includes a first bearing of an aerial vehicle detected by the first node;

receiving, from the second node, second node data that includes a second bearing of the aerial vehicle detected by the second node;

determining, based at least in part on the first node data and the second node data, an approximate position of the aerial vehicle; and providing, to at least one subscribing client including the first subscribing client, the approximate position.

16. The computer-implemented method of claim 15, further comprising:

receiving node data from each of the plurality of nodes, wherein each node is at a different geographic location;

determining, based on the node data received from the plurality of nodes, approximate positions of each of a plurality of aerial vehicles, wherein the aerial vehicle is included in the plurality of aerial vehicles; and providing air-traffic control for each of the plurality of aerial vehicles.

17. The computer-implemented method of claim 16, wherein at least some of the plurality of aerial vehicles:

do not provide any reporting information; and operate at an altitude of less than 500 feet.

18. The computer-implemented method of claim 15, wherein determining the approximate position of the aerial vehicle, further includes:

determining an intersection between the first bearing and the second bearing; and wherein the approximate position is based at least in part on the intersection.

19. The computer-implemented method of claim 15, wherein:

the first node data includes a first plurality of bearings of the aerial vehicle as detected by the first node over a period of time, wherein the first plurality of bearings includes the first bearing;

the second node data includes a second plurality of bearings of the aerial vehicle as detected by the second node over the period of time, wherein the second plurality of bearings includes the second bearing; and the computer-implemented method further comprising:

determining, based on the first node data and the second node data, a plurality of approximate positions of the aerial vehicle over the period of time, wherein the plurality of approximate positions includes the approximate position of the aerial vehicle; and determining, based at least in part on the plurality of approximate positions, a trajectory of the aerial vehicle.

* * * * *